US007391156B2

(12) United States Patent
Hasegawa et al.

(10) Patent No.: US 7,391,156 B2
(45) Date of Patent: Jun. 24, 2008

(54) PLASMA DISPLAY PANEL

(75) Inventors: Kazuyuki Hasegawa, Settsu (JP); Kaname Mizokami, Osaka (JP); Yoshinao Oe, Kyoto (JP); Masaki Aoki, Mino (JP)

(73) Assignee: Matsushita Electrical Industrial Co., Ltd., Osaka (JP)

( * ) Notice: Subject to any disclaimer, the term of this patent is extended or adjusted under 35 U.S.C. 154(b) by 0 days.

(21) Appl. No.: 10/535,951

(22) PCT Filed: Sep. 17, 2004

(86) PCT No.: PCT/JP2004/014022

§ 371 (c)(1),
(2), (4) Date: May 24, 2005

(87) PCT Pub. No.: WO2005/029530

PCT Pub. Date: Mar. 31, 2005

(65) Prior Publication Data

US 2006/0055324 A1 Mar. 16, 2006

(30) Foreign Application Priority Data

Sep. 24, 2003 (JP) ..... 2003-331163

(51) Int. Cl.
*H01J 17/49* (2006.01)
*H01J 9/00* (2006.01)
*H01J 9/24* (2006.01)

(52) U.S. Cl. ..... 313/587; 313/582; 313/586

(58) Field of Classification Search ..... 313/586, 313/587, 582

See application file for complete search history.

(56) References Cited

U.S. PATENT DOCUMENTS 6,879,107 B2 * 4/2005 Hirano et al. ..... 313/587
7,138,350 B2 11/2006 Sakurai et al.
7,166,961 B2 * 1/2007 Park ..... 313/587
7,196,472 B2 * 3/2007 Hasegawa et al. ..... 313/587

(Continued)

FOREIGN PATENT DOCUMENTS

EP 1 482 068 12/2004

(Continued)

OTHER PUBLICATIONS

Machine translation of JP 2003-226960.*

(Continued)

*Primary Examiner*—Nimeshkumar D. Patel
*Assistant Examiner*—Anthony T Perry
(74) *Attorney, Agent, or Firm*—Wenderoth, Lind & Ponack, L.L.P.

(57) ABSTRACT

A plasma display panel includes a first substrate and a second substrate facing each other to provide a discharge space between the first substrate and the second substrate, a scan electrode and a sustain electrode both provided on the first substrate, a dielectric layer for covering the scan electrode and the sustain electrode, and a protective layer provided on the dielectric layer. The protective layer includes MgO, at least one element of Si, Ge, C and Sn, and at least one element of fourth, fifth, sixth and seventh group elements of a periodic table. This plasma display panel performs stable discharge characteristics, such as a driving voltage, thereby displaying an image stably.

4 Claims, 6 Drawing Sheets

U.S. PATENT DOCUMENTS

| | | | | |
|---|---|---|---|---|
| 7,253,561 | B2 * | 8/2007 | Kim et al. | 313/587 |
| 2002/0121861 | A1 * | 9/2002 | Katou et al. | 313/587 |
| 2004/0027072 | A1 * | 2/2004 | Inoue et al. | 313/582 |

FOREIGN PATENT DOCUMENTS

| | | | | |
|---|---|---|---|---|
| JP | 5-234519 | | | 10/1993 |
| JP | 11339665 | A | * | 12/1999 |
| JP | 2000-63171 | | | 2/2000 |
| JP | 2000-103614 | | | 4/2000 |
| JP | 2000103614 | A | * | 4/2000 |
| JP | 2001294444 | A | * | 10/2001 |
| JP | 2002-352703 | | | 12/2002 |
| JP | 2003-27221 | | | 1/2003 |
| JP | 2003-109511 | | | 4/2003 |
| JP | 2003-226960 | | | 8/2003 |
| JP | 2003-272533 | | | 9/2003 |
| JP | 2004031264 | A | * | 1/2004 |
| WO | 03/046249 | | | 6/2003 |

OTHER PUBLICATIONS

Supplementary European Search Report (in English language) issued Sep. 5, 2007 in the European Application No. 04773406.06 PCT/JP2004014022 of which the present application is the U.S. National Stage.

* cited by examiner

Fig. 5

| Sample No. | Additive and Amount of Additive | Amount of Absorbed Impurity Gas | Flicker of Screen | | | | Decresing Rate of Brightness (%) | | | |
|---|---|---|---|---|---|---|---|---|---|---|
| | | | Xe:5% | Xe:10% | Xe:20% | Xe:50% | Xe:5% | Xe:10% | Xe:20% | Xe:50% |
| 1 | C:20ppm, Ti:100ppm | 0.80 | None | None | None | None | -1.9 | 0 | 0 | 0 |
| 2 | C:20ppm, Zr:5000ppm | 0.18 | None | None | None | None | -2 | 0 | 0 | 0 |
| 3 | C:20ppm, Zr:10000ppm | 0.15 | None | None | None | None | -2 | -0.4 | -0.3 | -0.5 |
| 4 | Ge:100ppm, Nb:50ppm | 0.7 | None | None | None | None | -1.7 | -1.9 | -2 | -2.2 |
| 5 | Si:50ppm, Zr:10ppm | 0.6 | None | None | None | None | -1.6 | -1.7 | -1.8 | -1.9 |
| 6 | Sn:200ppm, W:100ppm | 0.6 | None | None | None | None | -1.6 | -1.7 | -1.9 | -2.1 |
| 7 | Si:500ppm, Mn:20ppm | 0.7 | None | None | None | None | -1.7 | -1.9 | -2.1 | -2.3 |
| 8 | Ge:8000ppm, F:50ppm | 0.5 | None | None | None | None | -1.5 | -1.7 | -1.8 | -2 |
| 9 | Si:8000ppm, Ta:10ppm | 0.7 | None | None | None | None | -1.8 | -1.9 | -2.3 | -2.5 |
| 10 | Si:20ppm, Zr:1000ppm | 0.9 | None | None | None | None | -2 | -2.3 | -2.4 | -2.5 |
| 11 | Si:300ppm, Zr:5000ppm | 0.3 | None | None | None | None | -1.9 | -2.2 | -2.5 | -2 |
| 12 | Si:300ppm, Zr:10000ppm | 0.2 | None | None | None | None | -1.7 | -1.9 | -2.3 | -2.1 |
| 13 | Si:1500ppm, Cr:100ppm | 0.6 | None | None | None | None | -1.7 | -1.8 | -2 | -2.1 |
| 14 | Si:1500ppm, Mo:100ppm | 0.7 | None | None | None | None | -1.8 | -1.9 | -2.1 | -2.2 |

Fig. 6

| Sample No. | Additive and Amount of Additive | Amount of Absorbed Impurity Gas | Flicker of Screen | | | | Decresing Rate of Brightness (%) | | | |
|---|---|---|---|---|---|---|---|---|---|---|
| | | | Xe:5% | Xe:10% | Xe:20% | Xe:50% | Xe:5% | Xe:10% | Xe:20% | Xe:50% |
| 15 | Si:1500ppm, Hf:500ppm | 0.8 | None | None | None | None | -1.9 | -2.1 | -2.3 | -2.5 |
| 16 | Si:2000ppm, C:100ppm, W:100ppm | 0.5 | None | None | None | None | -1.4 | -1.6 | -1.8 | -1.7 |
| 17 | Si:500ppm, Ge:20ppm, Ti:100ppm | 0.4 | None | None | None | None | -1.3 | -1.5 | -1.5 | -1.7 |
| 18 | Si:500ppm, Sn:50ppm, Zr:100ppm | 0.3 | None | None | None | None | -1.2 | -1.4 | -1.5 | -1.4 |
| 19 | Si:500ppm, Sn:50ppm, Zr:5000ppm | 0.4 | None | None | None | None | -1.2 | -1.3 | -1.6 | -1.7 |
| 20 | Si:500ppm, Sn:50ppm, Zr:10000ppm | 0.32 | None | None | None | None | -1 | -1.4 | -1.7 | -1.8 |
| 21 | Ge:500ppm, C:500ppm, Mo:100ppm | 0.4 | None | None | None | None | -1.3 | -1.3 | -1.3 | -1.5 |
| 22 | Sn:5000ppm, C:100ppm, Nb:100ppm | 0.5 | None | None | None | None | -1.4 | -1.5 | -1.6 | -1.6 |
| 23 | Sn:500ppm, Ge:500ppm, Cr:100ppm | 0.4 | None | None | None | None | -1.3 | -1.5 | -1.4 | -1.7 |
| 24 | Si:20ppm, C:8000ppm, V:10ppm | 0.3 | None | None | None | None | -1.2 | -1.3 | -1.5 | -1.6 |
| 25 | Si:500ppm, C:1000ppm, F:30ppm | 0.1 | None | None | None | None | -1 | -1.1 | -1.2 | -1.4 |
| 26 | Sn:500ppm, Si:1000ppm, Ta:30ppm | 0.4 | None | None | None | None | -1.4 | -1.5 | -1.7 | -1.5 |
| 27 | Ge:500ppm, Sn:100ppm, W:800ppm | 0.3 | None | None | None | None | -1.3 | -1.5 | -1.5 | -1.7 |
| 28 | Si:500ppm, C:100ppm, Mo:100ppm | 0.3 | None | None | None | None | -1.2 | -1.4 | -1.3 | -1.4 |

Fig. 7

| Sample No. | Additive and Amount of Additive | Amount of Absorbed Impurity Gas | Flicker of Screen | | | | Decresing Rate of Brightness (%) | | | |
|---|---|---|---|---|---|---|---|---|---|---|
| | | | Xe:5% | Xe:10% | Xe:20% | Xe:50% | Xe:5% | Xe:10% | Xe:20% | Xe:50% |
| 29 | Si:1500ppm, C:1000ppm, F:30ppm | 0.08 | None | None | None | None | -0.9 | -1.1 | -1.3 | -1.4 |
| 30 | Si:5000ppm. C:1000ppm, Mn:30ppm | 0.5 | None | None | None | None | -1.4 | -1.5 | -1.6 | -1.8 |
| 31 | Si:500ppm, C:1000ppm, Cr:30ppm | 0.3 | None | None | None | None | -1.1 | -1.3 | -1.3 | -1.5 |
| 32 | Ge:500ppm, C:1000ppm, Ti:30ppm | 0.4 | None | None | None | None | -1 | -1.1 | -1.3 | -1.2 |
| 33 | Ge:500ppm, C:1000ppm, F:30ppm | 0.09 | None | None | None | None | -1.1 | -1.3 | -1.2 | -1.5 |
| 34 | Sn:20ppm, C:8000ppm, F:30ppm | 0.1 | None | None | None | None | -1.2 | -1.2 | -1.3 | -1.5 |
| 35 | Ge:500ppm, C:1000ppm, Cr:30ppm | 0.3 | None | None | None | None | -1 | -1.2 | -1.3 | -1.3 |
| 36 | Si:500ppm, C:1000ppm, Re:30ppm | 0.5 | None | None | None | None | -1.3 | -1.5 | -1.7 | -1.8 |
| 37 | Si:500ppm | 1 | None | None | Visible | Visible | -4.8 | -4.6 | -4.8 | -4.9 |
| 38 | Ge:500ppm | 1.4 | None | Visible | Visible | Visible | -6.1 | -6.4 | -6.5 | -6.7 |
| 39 | C:500ppm | 1.6 | None | Visible | Visible | Visible | -7.4 | -7.8 | -7.9 | -8.1 |
| 40 | None | 10.5 | Visible | Visible | Visible | Visible | -10.5 | -11.2 | -12.1 | -13.4 |

PLASMA DISPLAY PANEL

TECHNICAL FIELD

The present invention relates to a plasma display panel for displaying an image.

BACKGROUND OF THE INVENTION

Various types of display devices, such as a cathode ray tube (CRT), a liquid crystal display (LCD), and a plasma display panel (PDP), which are to be used for a high-definition and large display television, have been developed.

The PDP includes phosphor layers for emitting three primary colors, red (R), green (G), and blue (B) so as to perform full color display by adding and mixing three primary colors (red, green, and blue). The PDP has a discharge cell, and generates visible light by exciting phosphor layers with ultraviolet rays generated by a discharge in the discharge cell, thereby displaying an image.

In an AC type PDP, an electrode for main discharge is generally covered with a dielectric layer, and performs memory driving to reduce a driving voltage. When the dielectric layer deteriorates due to an impact of ions generated by the discharge and hitting the layer, the driving voltage may increase. To prevent this increasing, a protective layer for protecting the dielectric layer is formed on a surface of the dielectric layer. For example, a protective layer made of material having high sputtering resistance, such as magnesium oxide (MgO), is disclosed in pp. 79-80 in "ALL ABOUT PLASMA DISPLAY" co-authored by Hiraki Uchiike and Shigeo Mikoshiba, published by Kogyo Chosakai Publishing Inc. in May 1, 1997.

The protective layer made of MgO provides the following problems. MgO generally tends to be charged in positive. Mg has positive divalency, a strong ionicity, and a high secondary electron emission coefficient (γ-coefficient), hence decreasing a discharge voltage of the PDP. However, MgO having such a high γ-coefficient has a lot of crystal defects, particularly oxygen defects, and may absorb $H_2O$, $CO_2$, and hydrocarbon gas in the defects. This may decrease initial emission of electrons, make the discharge unstable, raise the driving voltage, or increase a variation of temperature characteristics of the PDP. (For example, see "PLASMA DISPLAY" published by Kyoritsu Shuppan Co., LTD, pp. 48-49, or "VACUUM" vol. 43, No. 10, 2000. p. 973.)

Pure MgO, which is divalent oxide, has a strong ionicity and a lot of the oxygen defects, and thus tends to be charged positively. (For example, see "SOLID-STATE SCIENCE AND TECHNOLOGY" published by J. Electrochem. Soc. pp. 841-847, April, 1986.) Therefore, MgO may easily adsorb water or carbon dioxide gas. Just after being deposited in a vacuum chamber, MgO hardly absorbs impurity gas, such as water, carbon dioxide gas, or hydrocarbon gas. However, MgO may absorb the impurity gas during a period when the panel is taken out from the vacuum chamber to proceed a subsequent process, during the sealing of the panel, or during a later aging process. This is caused by oxygen defects produced in MgO crystal. Mg element provided on a boundary is coupled with hydroxyl group (OH) or $CH_X$ group in air through the oxygen defects and is stabilized.

SUMMARY OF THE INVENTION

A plasma display panel includes a first substrate and a second substrate facing each other to provide a discharge space between the first substrate and the second substrate, a scan electrode and a sustain electrode both provided on the first substrate, a dielectric layer for covering the scan electrode and the sustain electrode, and a protective layer provided on the dielectric layer. The protective layer includes MgO, at least one element of Si, Ge, C and Sn, and at least one element of fourth, fifth, sixth and seventh group elements of a periodic table.

This plasma display panel performs stable discharge characteristics, such as a driving voltage, thereby displaying an image stably.

BRIEF DESCRIPTION OF THE DRAWINGS

FIGS. 5 to 7 show an evaluation result of the PDP in accordance with the embodiment.

DETAILED DESCRIPTION OF THE PREFERRED EMBODIMENT

Figure 1:
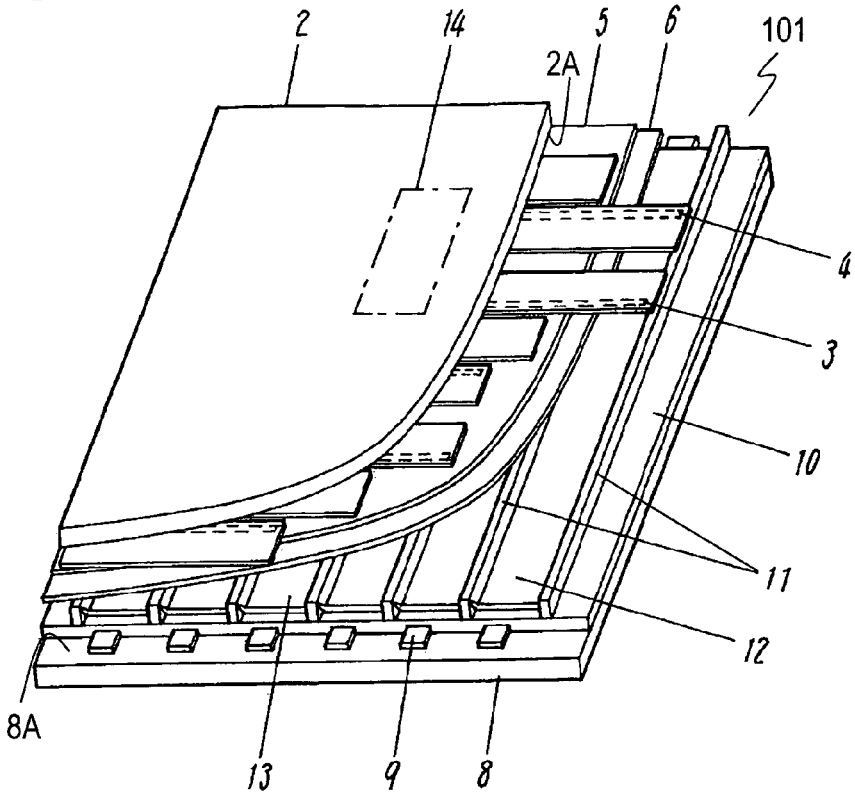
FIG. 1 is a partially-sectional, perspective view of a plasma display panel (PDP) in accordance with an exemplary embodiment of the present invention.
Figure 2:
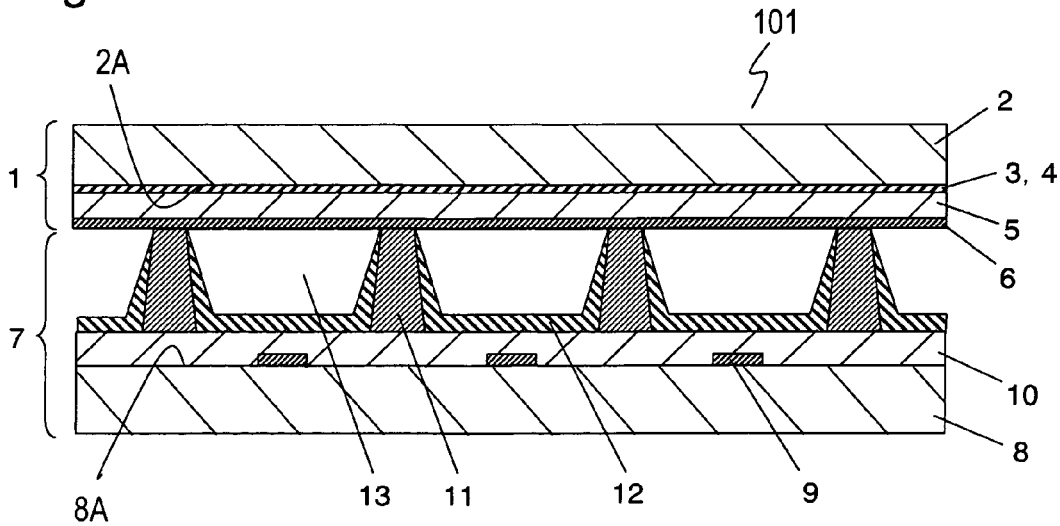
FIG. 2 is a sectional view of the PDP in accordance with the embodiment.

FIG. 1 is a partially-sectional, perspective view of an AC surface-discharge type plasma display panel (PDP) 101 for schematically illustrating a structure of the PDP. FIG. 2 is a sectional view of PDP 101.

In front panel 1, a pair of stripe scan electrode 3 and stripe sustain electrode 4 forms a display electrode. Plural pairs of scan electrode 3 and sustain electrode 4, i.e. plural of display electrodes, are provided on surface 2A of front glass substrate 2. Dielectric layer 5 covers scan electrode 3 and sustain electrode 4 is formed, and protective layer 6 for covering dielectric layer 5 is formed.

In rear panel 7, stripe address electrode 9 is provided on surface 8A of rear glass substrate 8 perpendicularly to scan electrode 3 and sustain electrode 4. Electrode protective layer 10 covering address electrode 9 protects address electrode 9, and reflects visible light in a direction towards front panel 1. Barrier ribs 11 are provided on electrode protective layer 10 and extend in the same direction as address electrode 9 and sandwich address electrode 9. Phosphor layer 12 is formed between barrier ribs 11.

Front glass substrate 2 faces rear glass substrate 8 to form discharge space 13 between the substrates. Discharge space 13 is filled with discharge gas, such as mixture rare gas of neon (Ne) and xenon (Xe), and sealed at a pressure of approximately 66500 Pa (500 Torr). Thus, an intersection between address electrode 9 and both of scan electrode 3 and sustain electrode 4 is separated by barrier ribs 11 to function as discharge cell 14, a unit emitting region.

In PDP 101, a driving voltage is applied to address electrode 9, scan electrode 3, and sustain electrode 4, so that discharge is generated at discharge cell 14. An ultraviolet ray generated by this discharge irradiates phosphor layer 12, and is converted into visible light to display an image.

Figure 3:
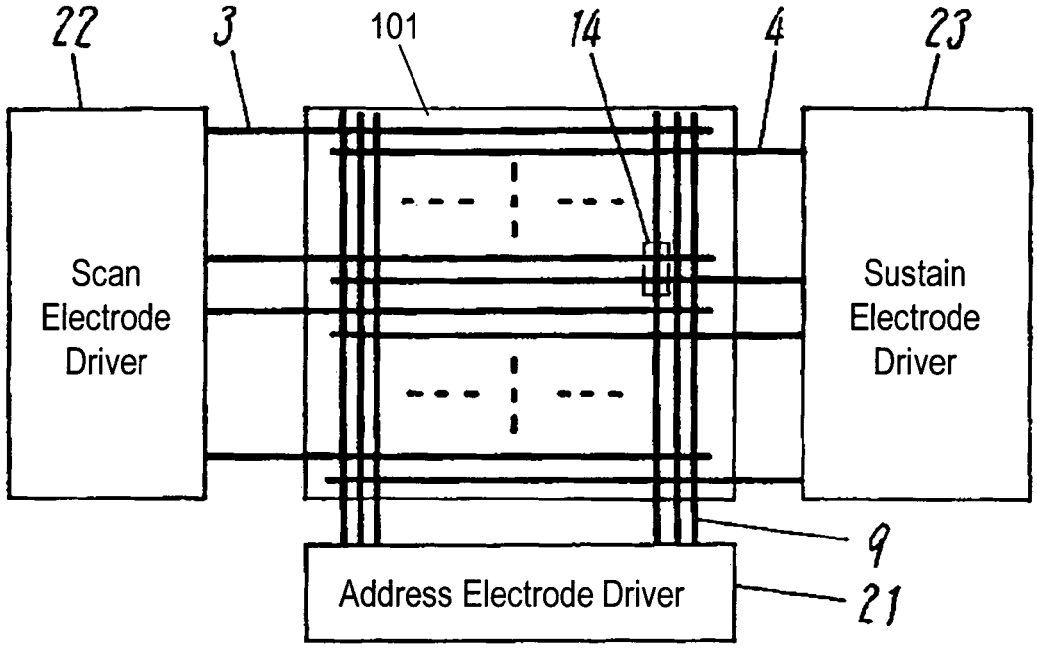
FIG. 3 is a block diagram of an image display using the PDP in accordance with the embodiment.

FIG. 3 is a block diagram of an image display including PDP 101 and a driving circuit for driving PDP 101 for schematically illustrating the display. Address-electrode driver 21 is connected to address electrode 9 of PDP 101, scan-electrode driver 22 is connected to scan electrode 3, and sustain-electrode driver 23 is connected to sustain electrode 4.

Figure 4:
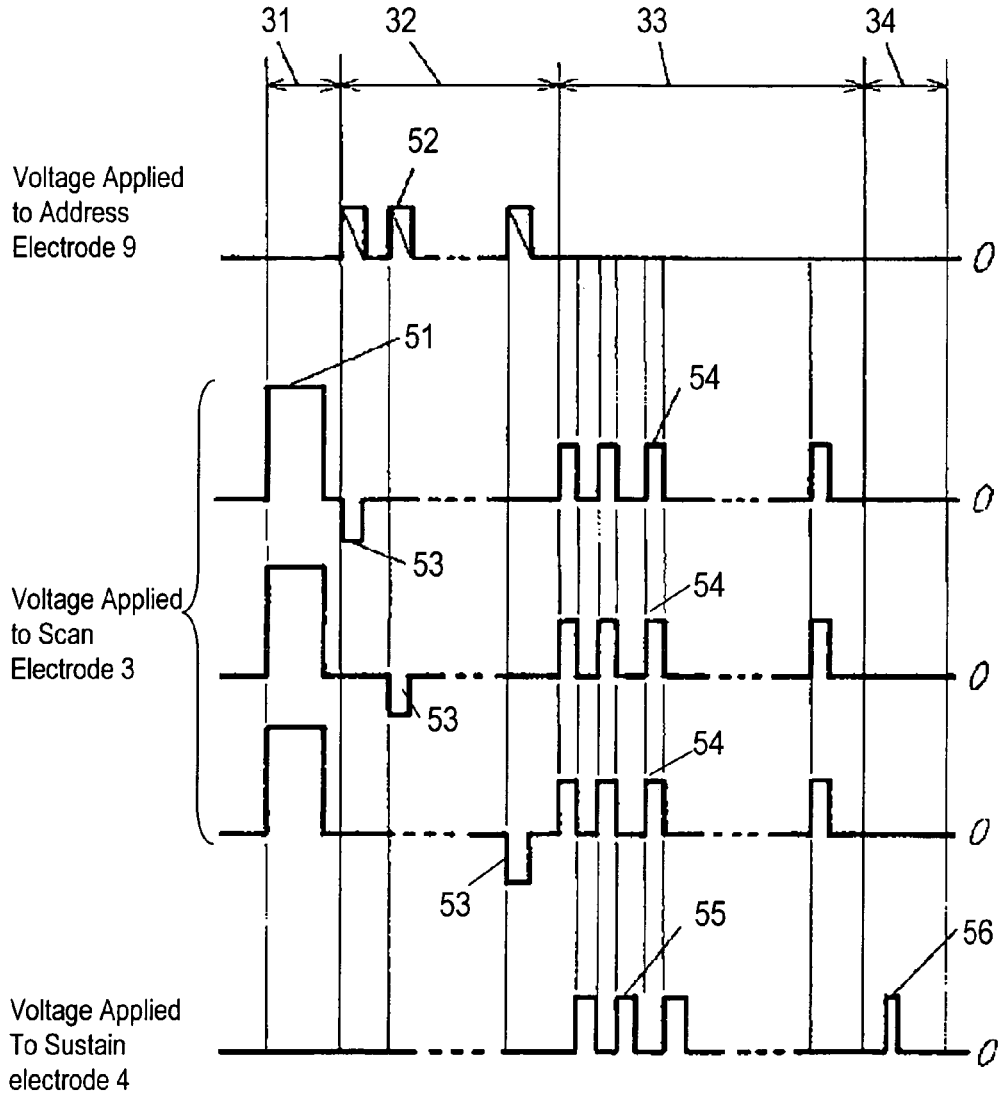
FIG. 4 is a timing chart of a driving waveform of the image display shown in FIG. 3.

In order to drive the image display using the AC surface-discharge type PDP 101, a single frame of an image is divided into plural subfields to display gradation on PDP 101. In this method, each subfield is further divided into four periods to control the discharge at discharge cell 14. FIG. 4 is a timing chart of a driving waveform in each subfield.

The timing chart of FIG. 4 shows the driving waveform of the image display shown in FIG. 3, and shows a voltage waveform applied to electrodes 3, 4 and 9 in each subfield. In setting-up period 31, initializing pulse 51 is applied to scan electrode 3 to cause all discharge cells 14 of PDP 101 to store wall electric charges for facilitating the discharge. In addressing period 32, data pulse 52 and scanning pulse 53 are applied to address electrode 9 and the scan electrode, respectively, which correspond to discharge cell 14 to illuminate. Thus, the discharge to cause discharge cell 14 to illuminate is generated. In sustaining period 33, sustain pulses 54 and 55 are applied to all scan electrodes 3 and sustain electrodes 4, respectively, so that discharge cell 14 having the discharge generated therein in addressing period 32 illuminates, and then the illumination is sustained. In erasing period 34, erasing pulse 56 is applied to sustain electrode 4, so that the wall electric charge stored in discharge cell 14 is erased to stop the illumination of discharge cell 14.

In setting-up period 31, initializing pulse 51 is applied to scan electrode 3, so that scan electrode 3 has an electric potential higher than potentials of both address electrode 9 and sustain electrode 4 to generate the discharge at each discharge cell 14. Electric charge generated by the discharge is stored on a wall of each discharge cell 14 so as to cancel a difference between the potential of address electrode 9 and the potential of each of scan electrode 3 and sustain electrode 4. Then, a negative electric charge as a wall electric charge is stored on a surface of protective layer 6 near scan electrode 3. A positive electric charge as a wall electric charge is stored on a surface of phosphor layer 12 near address electrode 9 and on a surface of protective layer 6 near sustain electrode 4. These wall electric charges provides a predetermined wall electric potential between scan electrode 3 and address electrode 9, and provides a predetermined wall electric potential between scan electrode 3 and sustain electrode 4.

In addressing period 32, scan pulses 53 are sequentially applied to scan electrodes 3, so that scan electrodes 3 have electric potentials lower than a potential of sustain electrode 4, and data pulse 52 is applied to address electrode 9 corresponding to discharge cell 14 to illuminate. At this moment, address electrode 9 has an electric potential higher than that of scan electrodes 3. That is, a voltage is applied between scan electrode 3 and address electrode 9 in the same polarity as the wall electric potential, and a voltage is applied between scan electrode 3 and sustain electrode 4 in the same polarity as the wall electric potential. These voltages generate a writing discharge at discharge cell 14. As a result, a negative electric charge is stored on a surface of phosphor layer 12 and a surface of protective layer 6 near sustain electrode 4, and a positive electric charge is stored on a surface of protective layer 6 near scan electrode 3. Thus, a predetermined wall electric potential is generated between sustain electrode 4 and scan electrode 3.

The writing discharge delayed by a discharge delay time after scan pulse 53 and data pulse 52 are applied to scan electrodes 3 and address electrode 9, respectively. If the discharge delay time is long, the writing discharge may not be generated in a period (addressing period) during which scan pulse 53 and data pulse 52 are applied to scan electrodes 3 and address electrode 9, respectively. At discharge cell 14 in which the writing discharge is not generated, even when sustain pulses 54 and 55 are applied to scan electrodes 3 and sustain electrode 4, the discharge is not generated, and phosphor layer 12 does not emit light, thus adversely affecting the image display. PDP 101, performing high resolution display, the addressing period assigned to scan electrode 3 becomes short, so that a probability that writing discharge is not generated becomes high. Furthermore, if the partial pressure of Xe in the discharge gas is not lower than 5%, the probability that the writing discharge is not generated becomes high. In addition, if barrier ribs 11 are not formed as stripe patterns shown in FIG. 1 but as a mesh pattern surrounding discharge cell 14, the probability that the writing discharge is not generated becomes high even in the case that a lot of the impurity gases remains.

In sustaining period 33, sustain pulse 54 is applied to scan electrodes 3 so that scan electrode 3 has an electric potential higher than that of sustain electrode 4. That is, a voltage is applied between sustain electrode 4 and scan electrode 3 in the same polarity as the wall electric potential generate a sustain discharge. As a result, discharge cell 14 can start illuminating. Sustain pulses 54 and 55 are applied to change respective polarities of sustain electrode 4 and scan electrode 3 alternately, thereby generating pulse emission intermittently in discharge cell 14.

In erasing period 34, narrow erasing pulse 56 is applied to sustain electrode 4 generate an insufficient discharge, thereby erasing the wall electric charge.

Protective layer 6 of PDP 101 of the embodiment will be described below.

Protective layer 6 is formed by providing an evaporation source including MgO, at least one element selected from C, Si, Ge and Sn, and at least one element selected from fourth, fifth, sixth and seventh group elements of a periodic table, heating the evaporation source is heated by a heating device, such as a Pierce type electron beam gun, in oxygen atmosphere, and depositing the heated source on dielectric layer 5. Gaseous element, such as fluorine, may be put into the evaporation source as a solid of fluoride, such as $MgF_2$. Protective layer 6 formed in the above method includes MgO, at least one element selected from Si, Ge, C and Sn, and at least one element selected from fourth, fifth, sixth and seventh group elements of the periodic table.

PDP 101 includes protective layer 6 discussed above. Protective layer 6 prevents an error that a writing discharge is not generated since shortening a discharge delay time in addressing period 32 for the following reason.

A conventional protective layer includes highly-pure, about 99.99% of MgO provided by a vacuum evaporation method (EB method), hence having a small electronegativity and a large ionicity. Therefore, Mg ion at a surface of the protective layer is unstable (in a high-energy state), hence adsorbing hydroxyl group (OH group) to be stable. (For example, see "COLOR MATERIAL" 69(9), 1996, pp. 623-631.) According to cathode luminescence analysis, it is confirmed that peaks of cathode luminescence caused by a lot of oxygen defects appears. The conventional protective layer has a lot of defects which adsorb impurity gas, such as $H_2O$, $CO_2$, and hydrocarbon ($CH_X$). (For example, see documents of Discharge Research Institute at Institute of Electrical Engineers of Japan EP-98-202, 1988, p. 21).

Reducing the strong ionicity of MgO is effective to reduce these defects and the adsorption. An element having a small ionicity (a strong covalent-bonding property), such as at least one of C, Si, Ge, and Sn, may be added to MgO, thereby reducing the ionicity. X—O bonding (where X is at least one element of C, Si, Ge and Sn) having a different covalent bonding property is accordingly put into plurality of Mg—O bondings having the strong ionicities in MgO, hence controlling the defects of MgO. That is, shallow defects related to the gas absorption of MgO decreases. The adsorption of $H_2O$, $CO_2$, and $CH_X$ into protective layer 6 is accordingly reduced.

At least one element of C, Si, Ge and Sn decreases the defects in MgO, and further, decreases emission of secondary electrons from MgO since reducing positively-charged tendency. This is caused by a decrease of a positive charge on a surface of protective layer 6 and a decrease of an ability of extracting electrons having negative charges according to the decrease of the positive charge.

In order to compensate the decreasing of the emission of the secondary electrons, at least one element of fourth, fifth, sixth, and seventh group elements may be further added to MgO of protective layer 6, thereby forming an impurity level between a valence band and a conduction band, and increasing an ability of emitting the secondary electrons.

For the above reason, at least one element of C, Si, Ge, and Sn, and at least one element of fourth, fifth, sixth, and seventh group elements which are added to MgO of protective layer 6 decreases the amount of the impurity gas adsorbed to MgO, and increases the amount of the emitted secondary electrons. The gas adsorption to MgO of protective layer 6 is restricted, the impurity gas entering into PDP 101 decreases accordingly. This restricts oxidation and reduction of phosphor layer 12 caused by the impurity gas, and prevents brightness from decreasing due to deterioration of phosphor layer 12.

In a process for forming protective layer 6, conditions, such as the value of an electron beam current, a partial pressure of oxygen, a temperature of substrate 2, do not affect the composition of protective layer 6 much, hence being determined arbitrarily. For example, a vacuum degree may be set to a value not higher than $5.0\times10^{-4}$ Pa, the temperature of substrate 2 may be set to a value not lower than 200° C., and a pressure for vapor deposition may be set to a value ranging from $3.0\times10^{-2}$ Pa to $8.0\times10^{-2}$ Pa.

A method of forming protective layer 6 is not limited to the vapor deposition mentioned above, but may be employ a sputtering method or an ion plating method. The sputtering method would employ a target formed by sintering MgO powder in air, and the target may include at least one element selected from C, Si, Ge and Sn, and at least one element selected from fourth, fifth, sixth and seventh group elements of the periodic table. The ion plating method would employ the evaporation source mentioned above for the vapor deposition method.

MgO, at least one element selected from C, Si, Ge and Sn, and at least one element selected from fourth, fifth, sixth and seventh group element of the periodic table are not necessarily mixed previously as materials. Protective layer 6 may be formed by preparing separate targets or evaporation sources and then mixing the materials evaporated.

Each concentration of at least one element selected from Si, Ge, C and Sn, ranges preferably from 20 ppm by weight to 8000 ppm by weight, and each concentration of at least one element selected from fourth, fifth, sixth and seventh group elements of the periodic table ranges preferably from 10 ppm by weight to 10000 ppm by weight. At least one element selected from fourth, fifth, sixth and seventh group elements of the periodic table is, for example, at least one selected from Ti (titanium), Zr (zirconium), Hf (hafnium), V (vanadium), Nb (niobium), Ta (tantalum), Cr (chromium), Mo (molybdenum), W (tungsten), Mn (manganese), Re (rhenium), and F (fluorine).

Next, a method of manufacturing PDP 101 of the embodiment will be described below. First, a method of manufacturing front panel 1 will be described.

Scan electrode 3 and sustain electrode 4 are formed on front glass substrate 2, and covered with lead-base dielectric layer 5. Protective layer 6 including MgO, at least one element selected from Si, Ge, C and Sn, and at least one element selected from fourth, fifth, sixth and seventh group elements of the periodic table is formed on a surface of dielectric layer 5, thus providing front panel 1.

In PDP 101 according to the embodiment, each of scan electrode 3 and sustain electrode 4 may include a transparent electrode and a silver electrode as a bus electrode formed on the transparent electrode. The transparent electrode is formed to have a stripe shape by a photolithography method, and the silver electrode is formed on the transparent electrode by a photolithography method. Then, these electrodes are baked.

Lead-based dielectric layer 5 has its composition of, for example, 75 wt. % of lead oxide (PbO), 15 wt. % of boron oxide ($B_2O_3$), and 10 wt. % of silicon oxide ($SiO_2$). Dielectric layer 5 is formed by, for example, screen printing and baking.

Protective layer 6 is formed by the vacuum deposition method, the sputtering method, or the ion plating method.

In order to form protective layer 6 by the sputtering method, the target including MgO and additive including 20 ppm by weight to 8000 ppm by weight of each of at least one element of Si, Ge, C and Sn and 10 ppm by weight to 10000 ppm by weight of each of at least one element of fourth, fifth, sixth and seventh group elements is sputtered in sputtering gas, such as Ar gas, and reaction gas, such as oxygen gas ($O_2$ gas), thereby providing protective layer 6. In this sputtering, while front glass substrate 2 is heated at a predetermined temperature (200° C.-400° C.), Ar gas and $O_2$ gas (if necessary) is put into a sputtering apparatus depressurized within a range from 0.1 Pa to 10 Pa by an exhausting apparatus, thereby providing protective layer 6. In order to facilitate adding the additive, simultaneously to the sputtering, while an electric potential ranging from −100V to 150V is applied to front glass substrate 2 by a bias supply, the target is sputtered to form protective layer 6. This process further improves its characteristics. The amount of the additive to be put into MgO is controlled by the amount of the additive in the target and a high-frequency electric power for generating discharge for the sputtering.

In the case that protective layer 6 is formed by the vacuum deposition method, front glass substrate 2 is heated at 200° C.-400° C., and a deposition chamber is depressurized at $3\times10^{-4}$ Pa by an exhausting apparatus. A predetermined number of evaporation sources of hollow cathodes and an electron beam is set in the chamber as to evaporate MgO and the additive added to MgO, i.e., at least one element selected from C, Si, Ge, and Sn and at least one element selected from fourth, fifth, sixth and seventh group elements of the periodic table. Then, these materials are deposited on protective layer 6 with using reaction gas, such as oxygen gas ($O_2$ gas). According to the embodiment, while $O_2$ gas is put into the deposition chamber depressurized within a range from 0.01 Pa to 1.0 Pa by the exhausting system. Then, MgO and the additive, i.e., 20 ppm by weight to 8000 ppm by weight of each of at least one element of C, Si, Ge and Sn of, and 10 ppm by weight to 10000 ppm by weight of each of at least one element of fourth, fifth, sixth and seventh group elements are evaporated by the electron beam or the evaporation source of the hollow cathode, thereby providing protective layer 6 on dielectric layer 5.

Next, a method of manufacturing rear panel 7 will be described below.

Silver-based paste is applied on rear glass substrate 8 by screen printing and then is baked to provide address electrode 9. Lead-based dielectric layer 18 for protecting the electrode is formed on address electrode 9 by screen printing, and is baked similarly to front panel 1. Barrier ribs 11 made of glass are provided at predetermined pitches and fixed. One of red phosphor, green phosphor and blue phosphor is provided in a space surrounded by barrier ribs 11, thus providing phosphor layer 12. In the case that barrier ribs are provided to form a mesh pattern surrounding discharge cell 14, another barrier rib is formed perpendicularly to barrier rib 11 shown in FIG. 1.

The phosphors in above may employ phosphors generally in PDPs, such as:

Red phosphor: $(Y_xGd_{1-x})BO_3$:Eu

Green phosphor: $Zn_2SiO_4$:Mn, (Y, Gd)$BO_3$:Tb

Blue phosphor: $BaMgAl_{10}O_{17}$:Eu

Front panel 1 and rear panel 7 manufactured by the above mothod are bonded with each other with sealing glass so that scan electrode 3 and sustain electrode 4 face address electrode 9 perpendicularly to address electrode 9. Then, discharge space 13 partitioned by barrier ribs 11 is exhausted to high vacuum (e.g. $3\times10^{-4}$ Pa) as exhausting baking. Then, the discharge gas having a predetermined composition is put into discharge space 13 at a predetermined pressure, hence providing PDP 101.

PDP 101, being used for 40-inch class hi-definition TV, has discharge cells 14 having small sizes and arranged by a small pitch, and therefore, may preferably includes the barrier ribs arranged in the mesh pattern to increase brightness.

The composition of the filling discharge gas may be of Ne—Xe-based. The partial pressure of Xe may be preferably determined to be not lower than 5%, and the pressure of the discharge gas may be preferably determined to be within 450-760 Torr to increase a brightness of the discharge cell.

Samples of the PDP manufactured by the above method were prepared and evaluated for evaluating performance of the PDP according to the present embodiment.

Compositions of the protective layers of the samples and compositions of discharge gases are shown in FIGS. 5 to 7. FIGS. 5 through 7 show additive elements to be added into the protective layer of MgO and its amount, where "ppm" of the amount of additive denotes "ppm" by weight. The amount of additive denotes the amount of each element as material (e.g. a target in the case that the protective layer is formed by the sputtering method) used for forming the protective layer. Protective layer formed by using material containing the additive element includes substantially the same amount of additive element as the amount of the additive element in the material. Mixture gas of Ne and Xe is used as the discharge gas, and FIGS. 5 to 7 show the partial pressure of Xe of the discharge gas. In the samples, the barrier ribs have heights of 0.12 mm, and an interval between the barrier ribs (i.e. pitch of the discharge cell) is 0.15 mm derived from a specification of a 42-inch hi-definition television set. The barrier ribs form the mesh pattern surrounding the discharge cell, and distance "d" between scan electrode 3 and sustain electrode 4 is 0.06 mm.

Mixture composition of 65 wt. % of lead oxide (PbO), 25 wt. % of boron oxide ($B_2O_3$), 10 wt. % of silicon oxide ($SiO_2$), and organic binder (α-terpineol containing 10% of etylcellulose dissolved therein) is applied by a screen printing method, and baked at 520° C. for 10 minutes, thereby providing dielectric layer 5. Dielectric layer 5 has a thickness of 30 μm.

Samples Nos. 1 to 8 includes protective layers formed by the sputtering method of the embodiment with using MgO, at least one element selected from Si, Ge, C, and Sn, and at least one element selected from fourth, fifth, sixth and seventh group elements of the periodic table. Each protective layer has a thickness of 0.9 μm, and includes 20 ppm by weight to 8000 ppm by weight of each of at least one element selected from C, Si, Ge and Sn of, and 10 ppm by weight to 10000 ppm by weight of each of at least one element selected from fourth, fifth, sixth, and seventh group elements.

Samples Nos. 9 to 36 includes protective layers produced by a vacuum deposition method with using MgO, maximum two of elements selected from C, Si, Ge, and Sn, and at least one element selected from fourth, fifth, sixth and seventh group elements.

Samples Nos. 37 to 40 are comparative examples. Protective layers of samples Nos. 37 to 39 are produced by adding only Si, Ge, and C to MgO, respectively. A protective layer of sample No. 40 is produced with only MgO.

Samples Nos. 1 to 40 of the PDP were measured in the amount of impurity gas adsorbed into the protective layers. PDPs after sealed and baked for exhausting were cut, front panels including the protective layers were heated in high vacuum and had temperatures raised. While gases were desorbed during the raising of the temperatures, the amounts of $H_2O$, $CO_2$, $C_2H_5$ were measured with a quadrupole mass spectrometer. In FIGS. 5 to 7, the amounts of the gases of sample No. 37 having the protective layer made of MgO and 500 ppm by weight of Si are expressed as "1", and the amounts of the gases of each sample are expressed as respective ratios of the amounts to the amounts of the gases of sample No. 37.

Further, images were displayed on the samples Nos. 1 to 40 of the PDP, and the samples were evaluated in image qualities (whether flicker or color shading caused by the discharge delay time was observed or not) by visual examinations. Results of the evaluation are shown in FIGS. 5 to 7.

Further, deterioration of brightness of samples Nos. 1 to 40 were measured by the following method. Each sample was activated with a voltage of 180V and a frequency of 150 kHz and displayed a white color on its entire screen, and an initial brightness of the screen was then measured. Next, after each sample emits light (corresponding to a sustain discharge) with a voltage of 180V and a frequency of 200 kHz for 1000 hours, the brightness of the screen was measured. The ratio of the brightness to the initial brightness is described in FIGS. 5 to 7.

Samples Nos. 1 to 36 had no flicker and no color shading of the screen, and a variation of the brightness after 1000-hour light-emitting was smaller than the comparative examples of samples Nos. 37 to 40.

Even when the partial pressure of Xe is not lower than 10%, samples Nos. 1 to 36 had no flicker and no color shading of the screen, and had little deterioration of the brightness after operating with the voltage of 180V and the frequency of 150 kHz for 1000 hours. This is caused by synergistic effects of: a small adsorption of the impurity gas, such as $H_2O$, $CO_2$, and hydrocarbon by the protective layer which mainly includes MgO and which further includes at least one element selected from Si, Ge, C and Sn; and a large secondary electron emission caused by at least one element selected from fourth, fifth, sixth and seventh group elements of the periodic table.

MgO of the protective layer is positively charged strongly, and has a lot of oxygen defects. C, Si, Ge and Sn, each of which has a electronegativity larger than that of Mg, reduce the strong positive charge and eliminate the oxygen defects, accordingly preventing MgO of the protective layer from absorbing the impurity gas, such as $H_2O$ and $CH_X$. The additive of at least one of C, Si, Ge, and Sn reduces the secondary electron emission. However, the additive of at least one of fourth, fifth, sixth and seventh group elements increases the secondary electron emission. The amount of the additive of at least one element selected from C, Si, Ge and Sn ranges preferably from 0.002% to 0.8% (20 ppm by weight to 8000 ppm by weight). If the amount of the additive is less than 0.002%, the effect of absorbing the impurity gas, such as $H_2$, $CO_2$, and hydrocarbon, may be reduced. The amount of the additive more than 0.8% may unpreferably decrease an adhesive effect of protective layer 6 to dielectric layer 5, or may unpreferably color protective layer 6. The amount of the additive of at least one element selected from fourth, fifth, sixth and seventh group elements ranges preferably from 0.001% to 1% (10 ppm by weight to 10000 ppm by weight). The amount of the additive less than 0.001% reduces the effect of increasing the secondary electron emission. The amount of the additive more than 1% may unpreferably color protective layer 6.

INDUSTRIAL APPLICABILITY

A plasma display panel of the present invention has stable discharge characteristics, such as a driving voltage, and displays an image stably.

The invention claimed is:

1. A plasma display panel comprising:

a first substrate and a second substrate facing each other to provide a discharge space between the first substrate and the second substrate;

a scan electrode and a sustain electrode both provided on the first substrate;

a dielectric layer for covering the scan electrode and the sustain electrode; and a protective layer provided on the dielectric layer, the protective layer including MgO, at least one element of Ge and Sn, and at least one element of fourth, fifth, sixth and seventh group elements of a periodic table;

wherein a concentration of each of the at least one element of Ge and Sn ranges from 20 ppm by weight to 8000 ppm by weight, and a concentration of each of the at least one element of fourth, fifth, sixth and seventh group elements of the periodic table ranges from 10 ppm by weight to 10000 ppm by weight, and wherein the at least one element of fourth, fifth, sixth and seventh group elements of the periodic table comprises at least one of Hf, V, Nb, Ta, Cr, Mo, W, Mn, Re, and F.

2. The plasma display panel of claim 1, further comprising a phosphor layer provided between the protective layer and the second substrate, wherein the discharge space is located between the protective layer and the phosphor layer.

3. A plasma display panel comprising:

a first substrate and a second substrate facing each other to provide a discharge space between the first substrate and the second substrate;

a scan electrode and a sustain electrode both provided on the first substrate;

a dielectric layer for covering the scan electrode and the sustain electrode; and a protective layer provided on the dielectric layer, the protective layer including MgO, at least one element of Si, Ge, C and Sn, and at least one element of fourth, fifth, sixth and seventh group elements of a periodic table, wherein a concentration of each of the at least one element of fourth, fifth, sixth and seventh group elements of the periodic table ranges from 5000 ppm by weight to 10000 ppm by weight. and wherein the at least one element of fourth, fifth, sixth and seventh group elements of the periodic table comprises at least one of Hf, V, Nb, Ta, Cr, Mo, W, Mn, Re, and F.

4. The plasma display panel of claim 3, further comprising a phosphor layer provided between the protective layer and the second substrate, wherein the discharge space is located between the protective layer and the phosphor layer.

* * * * *

UNITED STATES PATENT AND TRADEMARK OFFICE

CERTIFICATE OF CORRECTION

PATENT NO. : 7,391,156 B2
APPLICATION NO. : 10/535951
DATED : June 24, 2008
INVENTOR(S) : Kazuyuki Hasegawa et al.

It is certified that error appears in the above-identified patent and that said Letters Patent is hereby corrected as shown below:

IN THE CLAIMS

In column 10, claim 3, line 27, please change "by weight. and " to --by weight, and--.

Signed and Sealed this

Twenty-first Day of October, 2008

JON W. DUDAS
*Director of the United States Patent and Trademark Office*